US005903990A

United States Patent [19]

Huang

[11] Patent Number: 5,903,990

[45] Date of Patent: May 18, 1999

[54] CHINESE SEXAGENARY CYCLE CALENDAR

[76] Inventor: Yeh-Sheng Huang, 6/F-7, No. 2, Chung-Hsiao E. Rd., Sec. 4, Taipei City, Taiwan

[21] Appl. No.: 08/978,866

[22] Filed: Nov. 28, 1997

[51] Int. Cl.[6] ..... G09D 3/06

[52] U.S. Cl. ..... 40/119; 40/111; 40/486; 116/309; 434/304; 283/2

[58] Field of Search ..... 40/119, 120, 110, 40/493, 446, 447, 486, 111; 283/2; 116/307, 309, 311, 317; 434/304

[56] References Cited

U.S. PATENT DOCUMENTS

| | | | |
|---|---|---|---|
| 463,678 | 11/1891 | Fisher | 40/110 |
| 1,580,770 | 4/1926 | Welcker | 40/120 |
| 1,699,878 | 1/1929 | Coleman et al. | 40/120 |
| 2,136,490 | 11/1938 | Cohen | 40/110 X |
| 2,187,947 | 1/1940 | Marks | 40/493 X |
| 2,263,507 | 11/1941 | Lang | 40/111 |
| 3,383,786 | 5/1968 | McIntosh | 40/120 X |
| 4,133,289 | 1/1979 | Beattie | 116/309 |
| 4,308,678 | 1/1982 | Slobin | 40/110 X |
| 5,062,229 | 11/1991 | Werjefelt | 40/119 X |
| 5,715,618 | 2/1998 | Whang | 40/119 |

FOREIGN PATENT DOCUMENTS

| | | | |
|---|---|---|---|
| 416110 | 9/1934 | United Kingdom | 40/120 |

*Primary Examiner*—Brian K. Green
*Assistant Examiner*—Rodrigo J. Morales
*Attorney, Agent, or Firm*—Rosenberg, Klein & Bilker

[57] ABSTRACT

A Chinese sexagenary cycle calendar including a calendar stand, a celestial stem ball marked with the 10 celestial stem signs and revolvably supported within a ball socket at a front side of the calendar stand, and 12 individual animal pictures and one 12-animal table arranged in a loose-leaf manner and fastened to the calendar stand by a coil, the 12 individual animal pictures showing respectively the 12 animals of the 12 Terrestrial Branches and respectively marked with the 12 terrestrial branch signs, the 12-animal table comprising 12 animal blocks showing the 12 animals of the 12 terrestrial branches and marked with the 12 terrestrial branch signs respectively.

1 Claim, 4 Drawing Sheets

CHINESE SEXAGENARY CYCLE CALENDAR

BACKGROUND OF THE INVENTION

The present invention relates to a desk-top calendar, and more particularly to a Chinese sexagenary cycle calendar which uses a celestial stem ball marked with 10 celestial stem signs to match with 12 terrestrial animal pictures and one 12-animal table for showing a particular year.

In China and some Asian countries, the Terrestrial Branches are used in calculation with the Celestial stems to make a sexagenary cycle for showing the years, and 12 animals, namely, the mouse, the ox, the tiger, the rabbit, the dragon, the snake, the horse, the sheep, the monkey, the fowl, the dog, and the pig are selected to show the 12 Terrestrial Branches and the relation between the year and one's birth. Regular calendars are commonly designed for showing the months, weeks, and days of a particular year. There are few calendars designed for showing the sexagenary cycle.

SUMMARY OF THE INVENTION

The present invention has been accomplished under the circumstances in view. According to the present invention, the Chinese sexagenary cycle calendar comprises a calendar stand, a celestial stem ball marked with the 10 celestial stem signs and revolvably supported within a ball socket at a front side of the calendar stand, and 12 individual animal pictures and one 12-animal table arranged in a loose-leaf manner and fastened to the calendar stand by a coil, the 12 individual animal pictures showing respectively the 12 animals of the 12 terrestrial branches and respectively marked with the 12 terrestrial branch signs, the 12-animal table comprising 12 animal blocks showing the 12 animals of the 12 Terrestrial Branches and marked with the 12 terrestrial branch signs respectively.

DETAILED DESCRIPTION OF THE PREFERRED EMBODIMENT

Figure 1:
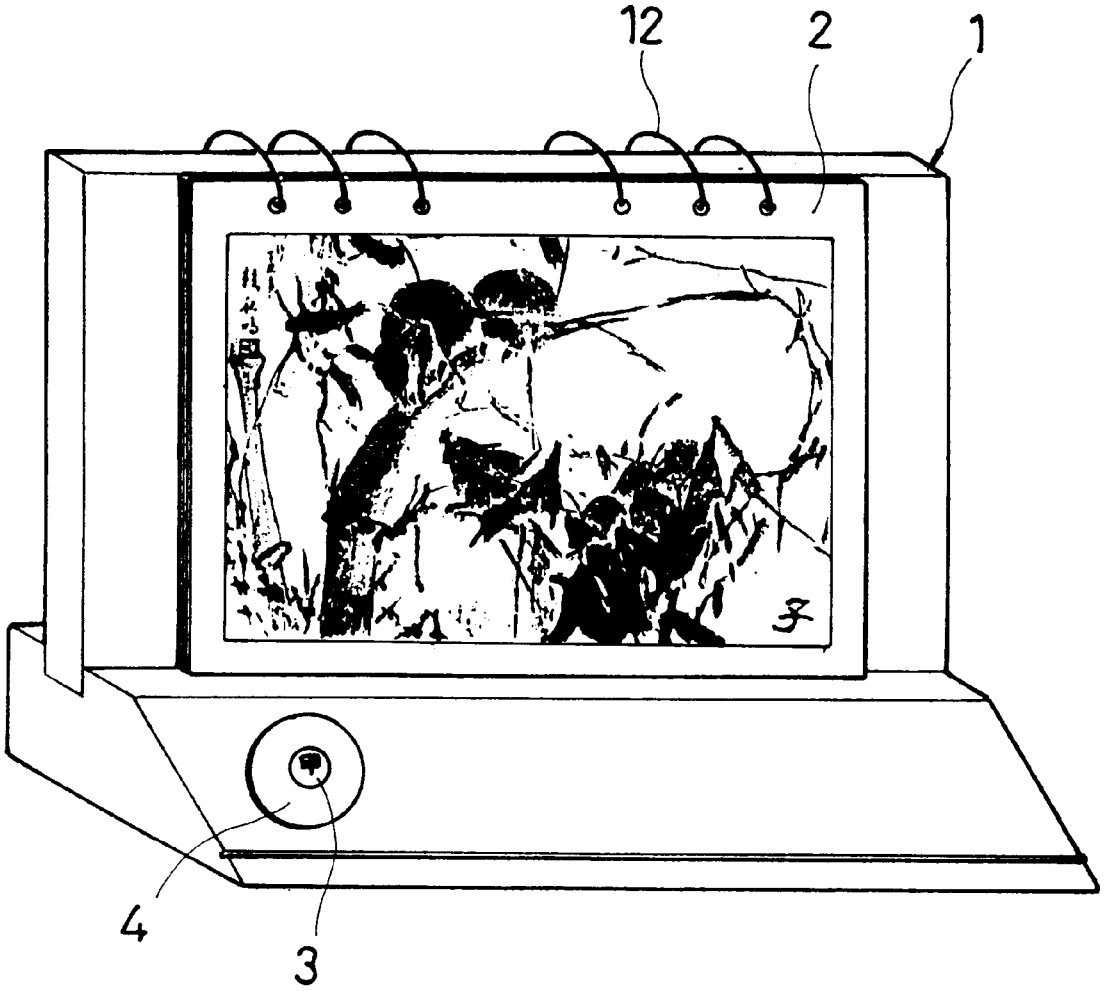
FIG. 1 is a perspective elevational view of a Chinese sexagenary calendar according to the present invention.
Figure 2:
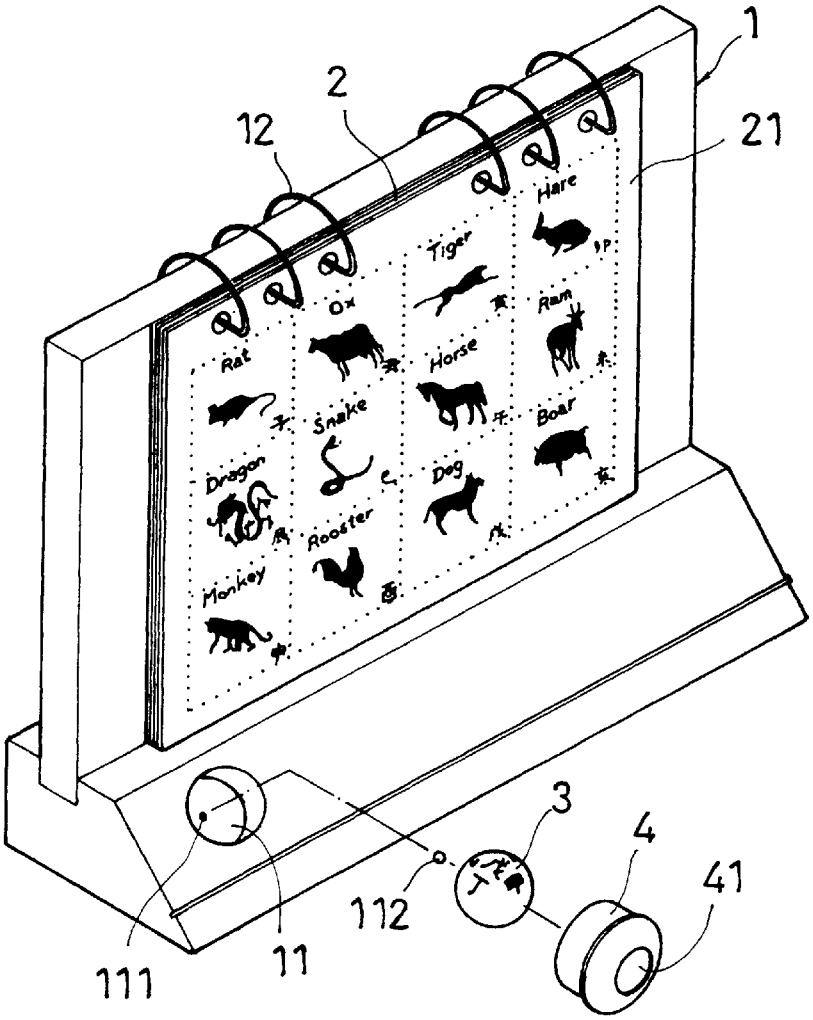
FIG. 2 is an exploded view of the Chinese sexagenary calendar shown in FIG. 1.
Figure 3:
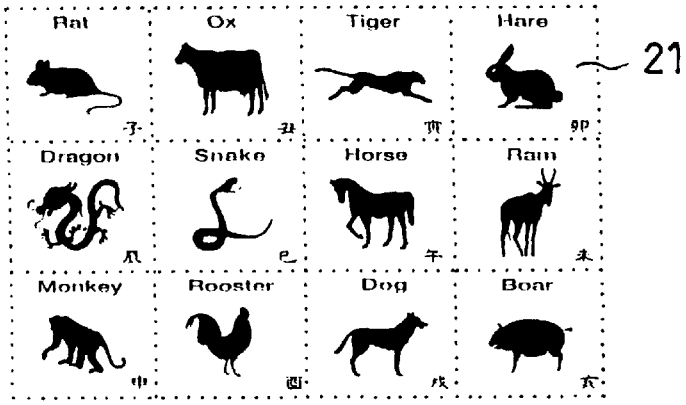
FIG. 3 is a front view of the 12-animal table.
Figure 2A:
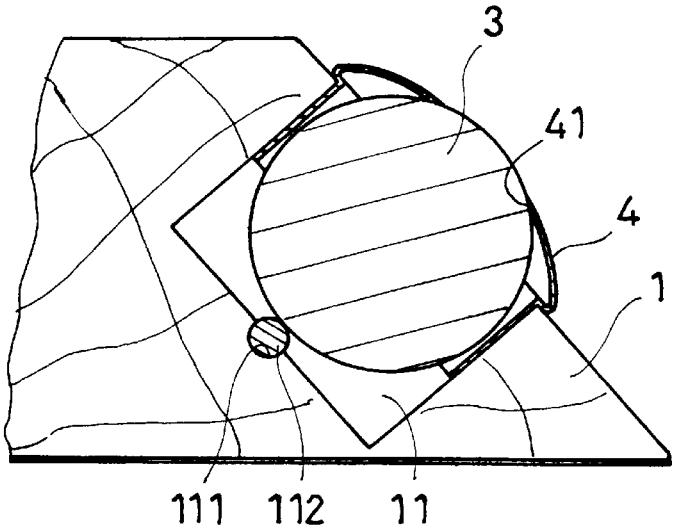
FIG. 2A is a partial view in an enlarged scale of the present invention, showing the celestial stem ball supported on the steel ball within the ball socket.
Figure 4:
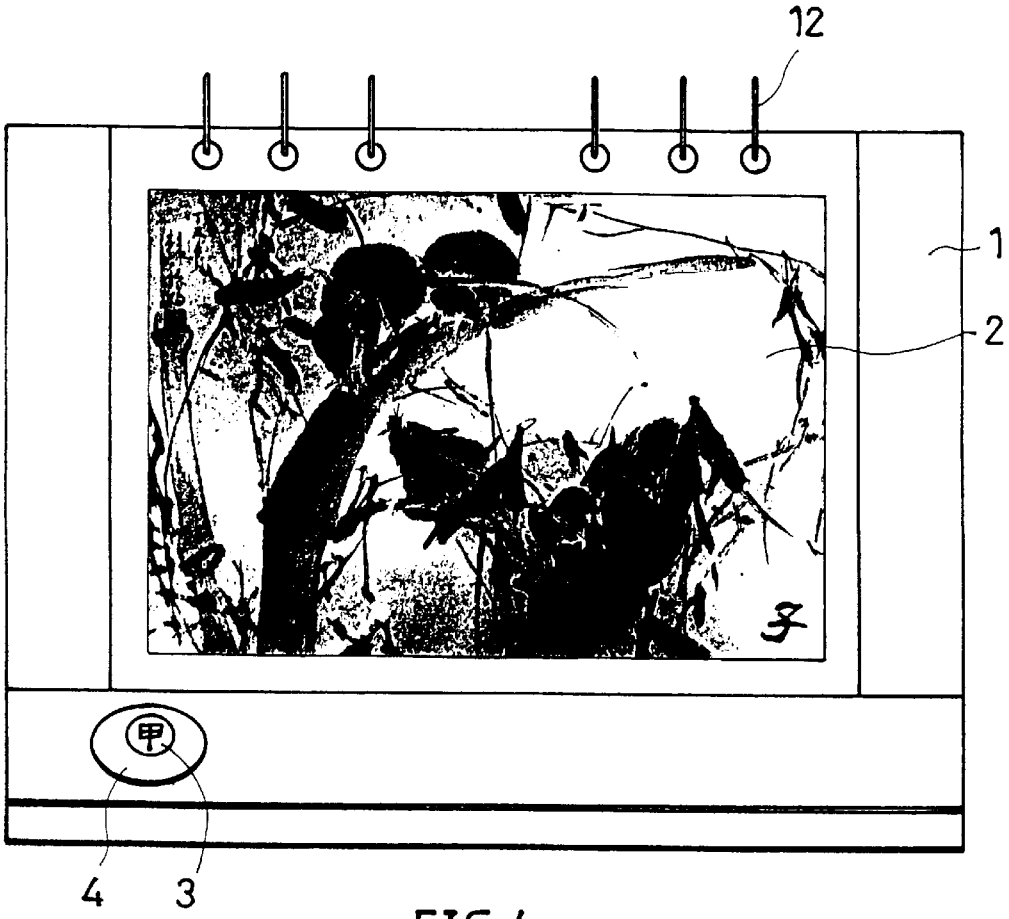
FIG. 4 shows one state of the present invention wherein the celestial sign of 甲 and the "mouse" animal picture are shown.
Figure 5:
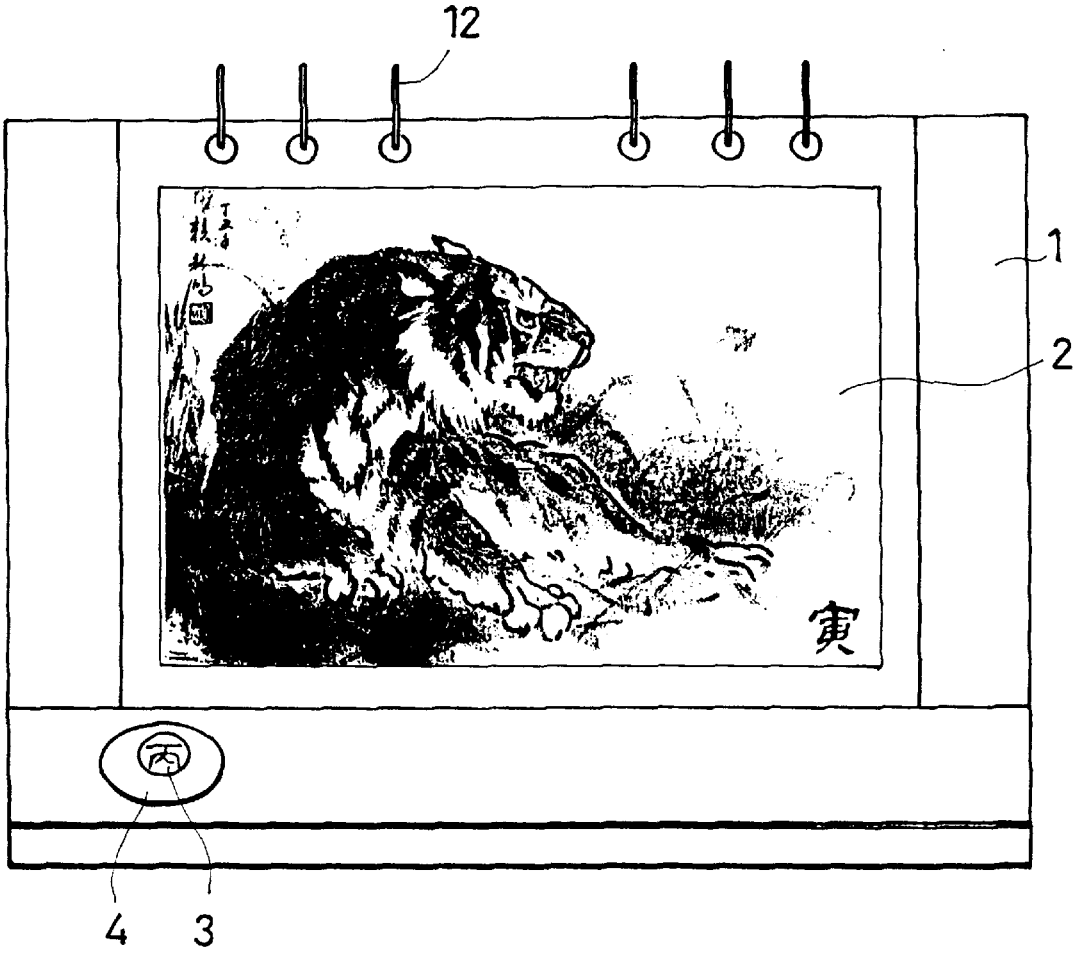
FIG. 5 shows one state of the present invention where the celestial sign of 丙 and the "tiger" animal picture are shown.

Referring to FIGS. 1, 2 and 2A, a Chinese sexagenary cycle calendar in accordance with the present invention comprises a calendar stand 1, 12 individual animal pictures 2 and one 12-animal table 21 arranged in a loose-leaf manner and fastened to the calendar stand 1 by a coil 12. The 12 individual animal pictures 2 show respectively the 12 animals (the mouse, the ox, the tiger, the rabbit (hare), the dragon, the snake, the horse, the sheep (ram), the monkey, the fowl (rooster), the dog, and the pig) of the 12 Terrestrial Branches, and are respectively marked with the 12 terrestrial branch signs of 子，丑，寅，卯，辰，巳，午，未，申，酉，戌，亥. The 12 terrestrial branch signs, namely, 子，丑，寅，卯，辰，巳，午，未，申，酉，戌，亥 are respectively marked on the 12-animal table in the corresponding 12 animal blocks. The calendar stand 1 comprises a recessed hole 11, a rounded recessed portion 111 at the center of the bottom side of the recessed hole 11. A ball socket 4 is mounted in the recessed hole 11, having a socket hole 41 at its front side. A steel ball 112 is mounted in the rounded recessed portion 111. A celestial stem ball 3 is supported on the steel ball 112 within the ball socket 4, and partially projecting out of the socket hole 41. The celestial stem ball 3 is marked with the 10 celestial stem signs of 甲，乙，丙，丁，戊，己，庚，辛，壬，癸.

When in use, the user can turn the celestial stem ball 3 to the position where the celestial stem sign is shown corresponding to the current year, and the 12 individual animal pictures are so arranged to let the animal picture which corresponds to the current year be shown at the front side.

What the invention claimed is:

1. A Chinese sexagenary cycle calendar comprising:

a calendar stand, said calendar stand comprising a recessed hole, a rounded recessed portion at a center of a bottom side of said recessed hole, a ball socket mounted in said recessed hole, said ball socket having a socket hole at a front side thereof, a steel ball mounted in said rounded recessed portion, and a celestial stem ball revolvably supported on said steel ball within said ball socket and partially projecting out of the socket hole of said ball socket, said celestial stem ball marked with 10 celestial stem signs of 甲，乙，丙，丁，戊，己，庚，辛，壬，癸 and 12 individual animal pictures and one 12-animal table arranged in a loose-leaf manner and fastened to said calendar stand by a coil, said 12 individual animal pictures showing respectively 12 animals (the mouse, the ox, the tiger, the rabbit, the dragon, the snake, the horse, the sheep, the monkey, the rooster, the dog, and the pig) of 12 Terrestrial Branches, and are respectively marked with 12 terrestrial branch signs of 子，丑，寅，卯，辰，巳，午，未，申，酉，戌，亥, said 12-animal table comprising 12 animal blocks showing the 12 animals of the 12 Terrestrial Branches and marked with the 12 terrestrial branch signs of 子，丑，寅，卯，辰，巳，午，未，申，酉，戌，亥 respectively.

* * * * *